US010788057B2

(12) United States Patent
Piippo

(10) Patent No.: US 10,788,057 B2
(45) Date of Patent: Sep. 29, 2020

(54) HYDRAULIC VALVE BODY AND HYDRAULIC VALVE MECHANISM COMPRISING THE BODY

(71) Applicant: Hydraulic Piippo, Kiuruvesi (FI)

(72) Inventor: Terho Piippo, Kiuruvesi (FI)

(73) Assignee: Hydraulic Piippo, Kiuruvesi (FI)

( * ) Notice: Subject to any disclaimer, the term of this patent is extended or adjusted under 35 U.S.C. 154(b) by 188 days.

(21) Appl. No.: 15/983,032

(22) Filed: May 17, 2018

(65) Prior Publication Data

US 2018/0266448 A1 Sep. 20, 2018

Related U.S. Application Data

(63) Continuation of application No. PCT/FI2016/050419, filed on Jun. 13, 2016.

(30) Foreign Application Priority Data

Jun. 11, 2015 (FI) ..... 20155450
Dec. 10, 2015 (FI) ..... 20155938

(51) Int. Cl.
*F15B 13/08* (2006.01)
*F15B 13/07* (2006.01)

(52) U.S. Cl.
CPC ..... *F15B 13/0807* (2013.01); *F15B 13/07* (2013.01); *F15B 13/0871* (2013.01); *F15B 13/0835* (2013.01); *F15B 13/0842* (2013.01); *F15B 13/0892* (2013.01); *F15B 13/0896* (2013.01); *F15B 2211/3059* (2013.01); *F15B 2211/625* (2013.01); *F15B 2211/71* (2013.01); *F15B 2211/782* (2013.01)

(58) Field of Classification Search
CPC .. F15B 13/0807; F15B 13/07; F15B 13/0871; F15B 2211/71; F15B 13/0892; F15B 2211/3059; F15B 2211/782; F15B 13/0842; F15B 13/0835; Y10T 137/87885
USPC ..... 137/884
See application file for complete search history.

(56) References Cited

U.S. PATENT DOCUMENTS

| | | | |
|---|---|---|---|
| 3,556,144 | A | 1/1971 | Bickers et al. |
| 3,756,274 | A | 9/1973 | Wolfgramm |
| 2007/0130935 | A1 | 6/2007 | Stephenson et al. |

FOREIGN PATENT DOCUMENTS

| | | | |
|---|---|---|---|
| AT | 500715 | A1 | 3/2006 |
| EP | 1371855 | A1 | 12/2003 |
| WO | 20150086908 | A1 | 6/2015 |

OTHER PUBLICATIONS

European Patent Office, Extended Search Report of European Patent Application No. 16806950.8, dated Jan. 30, 2019, 3 pages.

*Primary Examiner* — Michael R Reid
(74) *Attorney, Agent, or Firm* — Berggren LLP

(57) ABSTRACT

A hydraulic valve body, comprising two main lines for bringing pressurized hydraulic fluid into the body's channel system and further out of the channel system. The body further comprises at least two outlet fittings for conducting hydraulic fluid from the body's channel system to actuators and two respective inlet fittings for conducting hydraulic fluid from the actuators back into the channel system.

16 Claims, 6 Drawing Sheets

HYDRAULIC VALVE BODY AND HYDRAULIC VALVE MECHANISM COMPRISING THE BODY

PRIORITY

This application is a continuation application of International application number PCT/FI2016/050419 filed on Jun. 13, 2016 and claiming priority of Finnish national applications number FI20155450 filed on Jun. 11, 2015 and FI20155938 filed on Dec. 12, 2015, the contents of both of which are incorporated herein by reference.

FIELD OF THE INVENTION

The invention relates to a hydraulic valve body, which is adapted to be used for controlling actuators external of the body. In addition, the invention relates to a hydraulic valve mechanism comprising said body.

BACKGROUND

The prior art discloses a variety of hydraulic valve bodies for controlling actuators external of the body. Hydraulic bodies are used, by controlling valves included therein, to guide a hydraulic fluid, such as hydraulic oil, in a desired manner to specific targets. Inlet fittings included in a hydraulic valve body have hydraulic lines connected thereto and, respectively, hose fittings have hydraulic hoses connected thereto. It is by controlling and moving spindles present inside the body that hydraulic oil is enabled to proceed to specific hoses. Such a control can be implemented by being managed electrically, pneumatically or mechanically. When using hydraulic oils, the hoses are occasionally subjected to pressure shocks, which may inflict damage. The occurrence of mishaps is averted by using safety valves as well as non-return valves.

Figure 1:
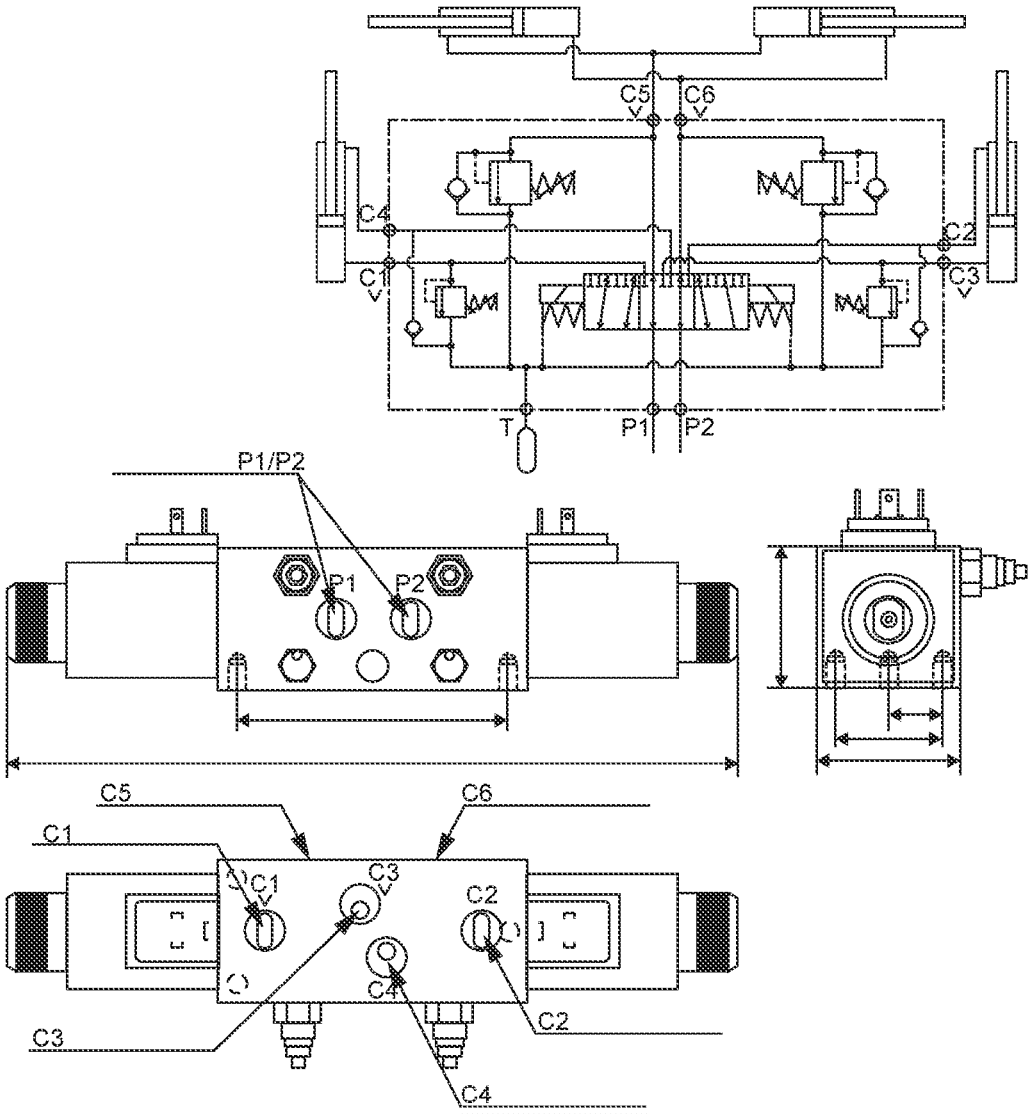
FIG. 1 PRIOR ART

One such hydraulic valve body is shown in FIG. 1 (Prior Art), wherein the body comprises channels therein, hose fittings (C1-C6) for connecting actuators (E1-E4), and inlet fittings (P1, P2) for hydraulic fluid. The body is further outfitted with sites for control elements, such as for externally controlled spindles, for guiding the fluid to a specific hose fitting. The body also comprises sites for one or more safety valves to be accommodated therein, whose cartridge chambers are connected with a channel to a return fitting for returning to a reservoir/pressure accumulator the hydraulic fluid coming in by way of the safety valve (the Applicant's valve body "E8312P4").

A problem with many prior art solutions is nevertheless for example not as such enabling the execution of very many actions independent of each other. In addition, some valve mechanisms of the prior art do not make it possible that the pressure spike caused by a shock applied on an actuator or on its other side, for example on the cylinder piston side, be smoothly discharged onto the cylinder rod side or elsewhere, whereby the actuator or the valve mechanism or both may be wrecked by the pressure shock.

Moreover, the prior known solutions do not enable for example a floating actuator position, which is for example where the actuator is used to control a heavy machine's drawbars to which is linked a soil working plow. Plowing provides an optimal result with a so-called floating position, wherein the drawbars' mechanical side guards are open. This causes problems whenever the plow is lifted up as it is free to swing uncontrollably in lateral direction. There are existing solutions, wherein the lateral adjustment of drawbars (at the same time, the side guards as well) is replaced by hydraulic cylinders (actuators). The current solutions do not, however, allow for a floating position, nor pressure shocks applied to drawbars and thereby to side guards.

SUMMARY OF THE INVENTION

One objective of the invention is to introduce such a hydraulic valve body which enables elimination or at least alleviation of the prior art-related problems. According to one embodiment, the invention endeavors to provide such a single hydraulic valve body that has no need for hose installations between various valves. Another objective is to simplify the installation of valves as well as components related thereto, as well as to introduce such a hydraulic valve body which is simple in construction and which single valve body is configurable in view of attaining at least the foregoing (and to be described more precisely elsewhere in this document) functions (most preferably at least 11 different flow circuits and functions). It is one objective of the invention to introduce such a hydraulic valve body which is adaptable for controlling several types of actuators, yet with the number of body components, such as valves, as few as possible.

Such objectives of the invention are attained with a hydraulic valve body according to claim 1.

The hydraulic valve body of the invention is characterized by what is presented in claim 1 directed to a hydraulic valve body. In addition, the hydraulic valve mechanism of the invention is characterized by what is presented in claim 15 directed to a hydraulic valve mechanism.

In the invention, according to a first embodiment, the hydraulic valve body comprises two main lines for bringing pressurized hydraulic fluid into a channel system of said body and further out of the channel system. The main fittings are most preferably adapted to be coupled with the pressure and return lines of a heavy machine. The body comprises at least two outlet fittings for conducting hydraulic fluid from the body's channel system to actuators and two respective inlet fittings for conducting hydraulic fluid from the actuators back into the body's channel system.

The body further comprises a first channel provided between the first main line and the first outlet and a second channel provided between the first main line and the second outlet, as well as a third channel provided between the second main line and the first inlet. In addition, between the first inlet and the second inlet the body is provided with a third connecting channel.

According to this embodiment, in connection with two of said outlet fittings, the body is further provided with first and second cartridge chambers for two control elements operating independently of each other for conducting a pressure flow by way of the respective first or second channel from the first main line to at least one actuator connected to the outlets.

In connection with one of said inlet fittings, the body is further provided with a third cartridge chamber for a third control element operating independently of the other control elements actuators for conducting a pressure flow from the actuator connected to at least one of the inlet fittings back into the second main line by way of the third channel, or by way of the third connecting channel and the third channel.

According to one example, the control element can be for example a solenoid valve. According to one example, said control channels are boreholes which can be fitted with a control element, for example a solenoid valve.

In the invention, according to one embodiment, the hydraulic valve mechanism comprises a body as described in the foregoing. The mechanism further comprises first and second cartridge chambers provided in connection with two of said outlet fittings, as well as first and second control elements, for example solenoid valves, provided in said first and second control channels and capable of being controlled from outside independently of each other, for conducting a pressure flow from the first main line by way of the first or second channel in a controllable manner to at least one actuator connected to the outlet fittings. Still further, the mechanism comprises a third cartridge chamber provided in connection with one of said inlet fittings and therein a third control element operating independently of the other control elements for conducting a pressure flow from an actuator connected to at least one of the inlet fittings back into the second main line in a controllable manner by way of the third channel, or by way of the third connecting channel and the third channel.

According to one example, the control element may comprise a movable spindle provided in the cartridge chamber (for example a seat spindle or the like spindle or other tool known for a person skilled in the art), said spindle being adapted to achieve at least some of the configurations and functions (flow circuits) of said body's channel system. Said control element can be for example a solenoid valve or a pneumatically, hydraulically or mechanically controlled valve.

According to one embodiment of the invention, the valve body can be expanded with attachments, such that the coupling and controlling of even several hydraulically controlled implements is possible with a mechanism of the invention.

The invention offers distinct benefits with respect to the prior art. Now, a single valve body, which includes channel structures described in this document, is capable of achieving the aforesaid functions, as well as other further functions described in this document, at least 11 functions in total. It is particularly notable that the valve body solution of the invention, its channel systems, and connections between various outlets and inlets as well as the main lines, are adapted in such a way that all said functions are achievable by using just three external control elements such as solenoid valves. This is a clear advantage because, for example in prior known solutions, the control of two actuators connected to the body's two outlets and inlets has required four control elements and, in addition, said body solutions have not enabled as many different functions as the body of the present invention, such as for example a floating position and a viable control of pressure shocks. Accordingly, the execution of said functions no longer necessitates several separate valve bodies and at least four or more external control elements such as solenoid valves. This is an obvious cost saving and moreover the valve body and its operation is considerably more reliable with moving and controlled parts fewer than before.

It should further be noted that the mechanism of the invention can be used for example for hydraulically controlling, particularly for example in lateral direction, the side guards of a tractor or other heavy machine, and it can be either an attachment for machines already in existence or a component capable of being integrated with new machines as early as in the process of manufacturing the machines. Indeed, by means of a hydraulic mechanism of the invention, it is possible to hydraulically control for example the side guards of currently available tractors, especially in lateral direction, independently of each other. Likewise, in up/down direction, the control is possible as the body has two sets of additional outlets and inlets. This facilitates, first of all, the hitching of work implements to a tractor, but is also a factor contributing qualitatively to the actual work performance. The mechanism for example enables the free floating position of a tractor-hitched work implement, which is very important for example in the process of drawing a furrow in a plowing position, whereby the management of lateral forces has a very important role (the pressure generated by lateral forces can be discharged from side to side by means of a mechanism of the invention by opening the valves between sidebars in the mechanism). In addition, and at the same time, the invention makes it possible to limit the lateral movement of a tractor-hitched work implement as the work implement is in an uplifted position, which is a significant safety factor, denying (locking) a lateral movement of the work implement for example for the duration of transport (by closing the valves between sidebars in the mechanism).

SHORT DESCRIPTION OF THE FIGURES

Figure 2:
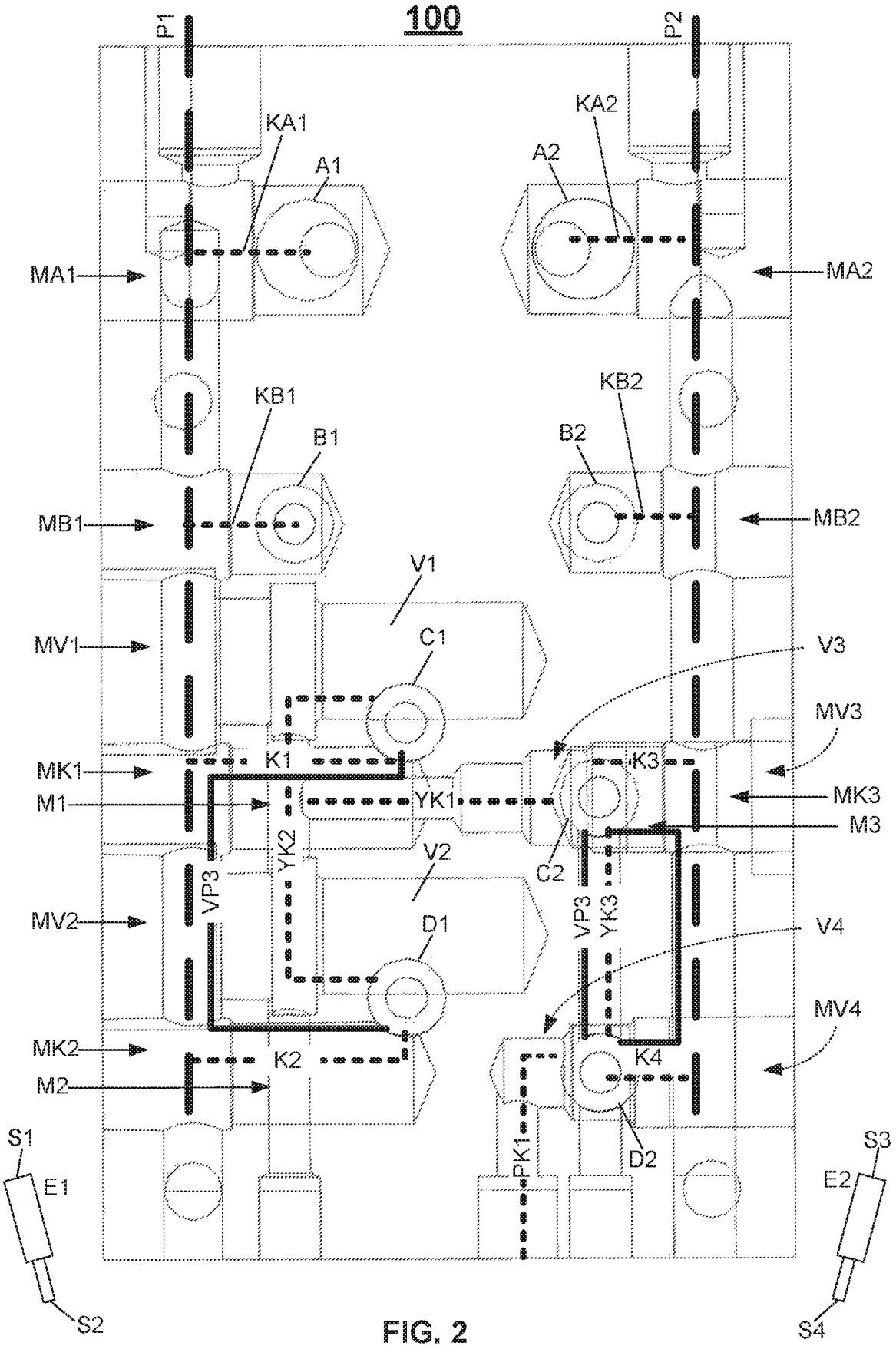
Figure 3:
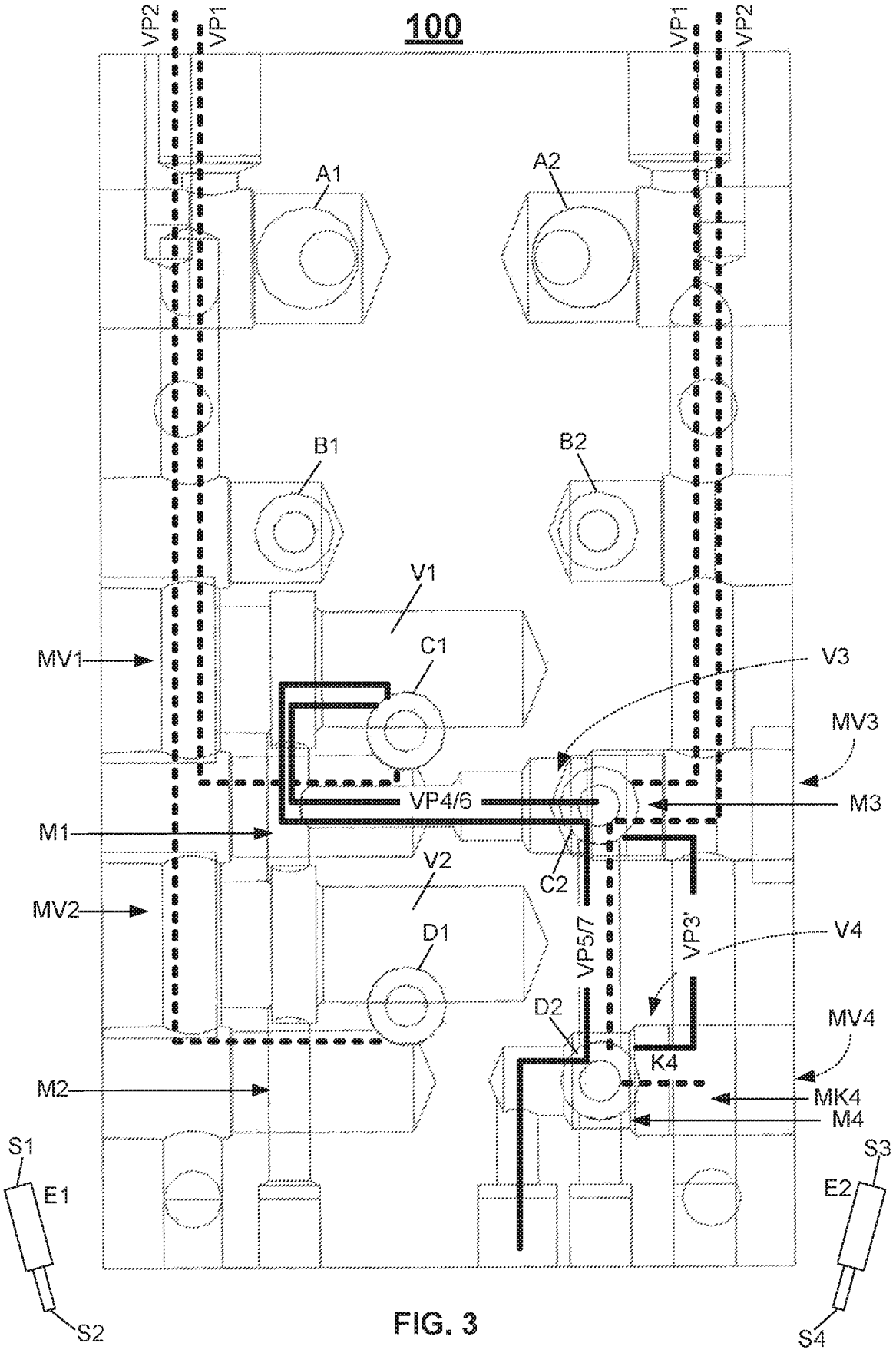
Figure 4:
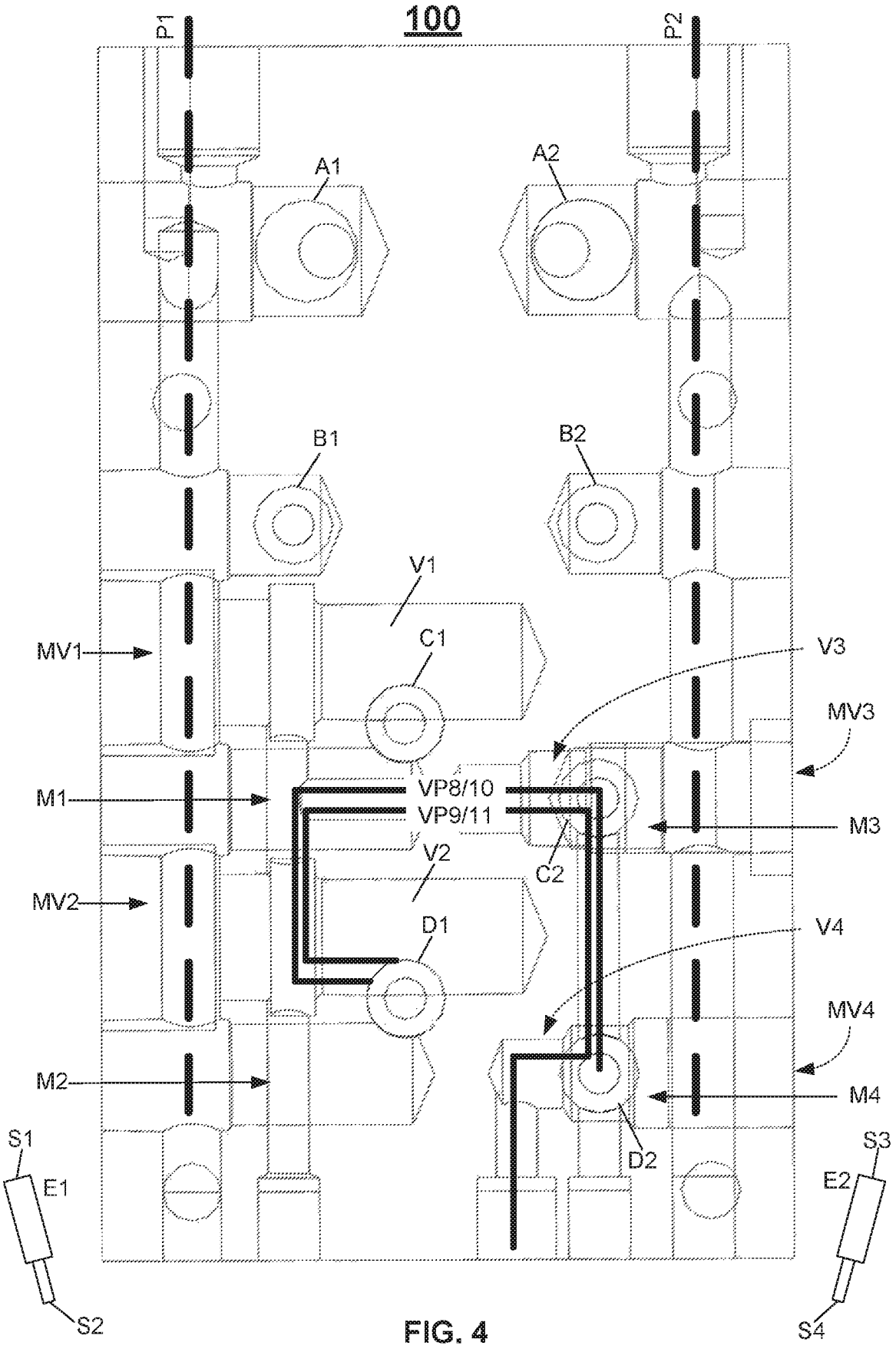
Figure 5:
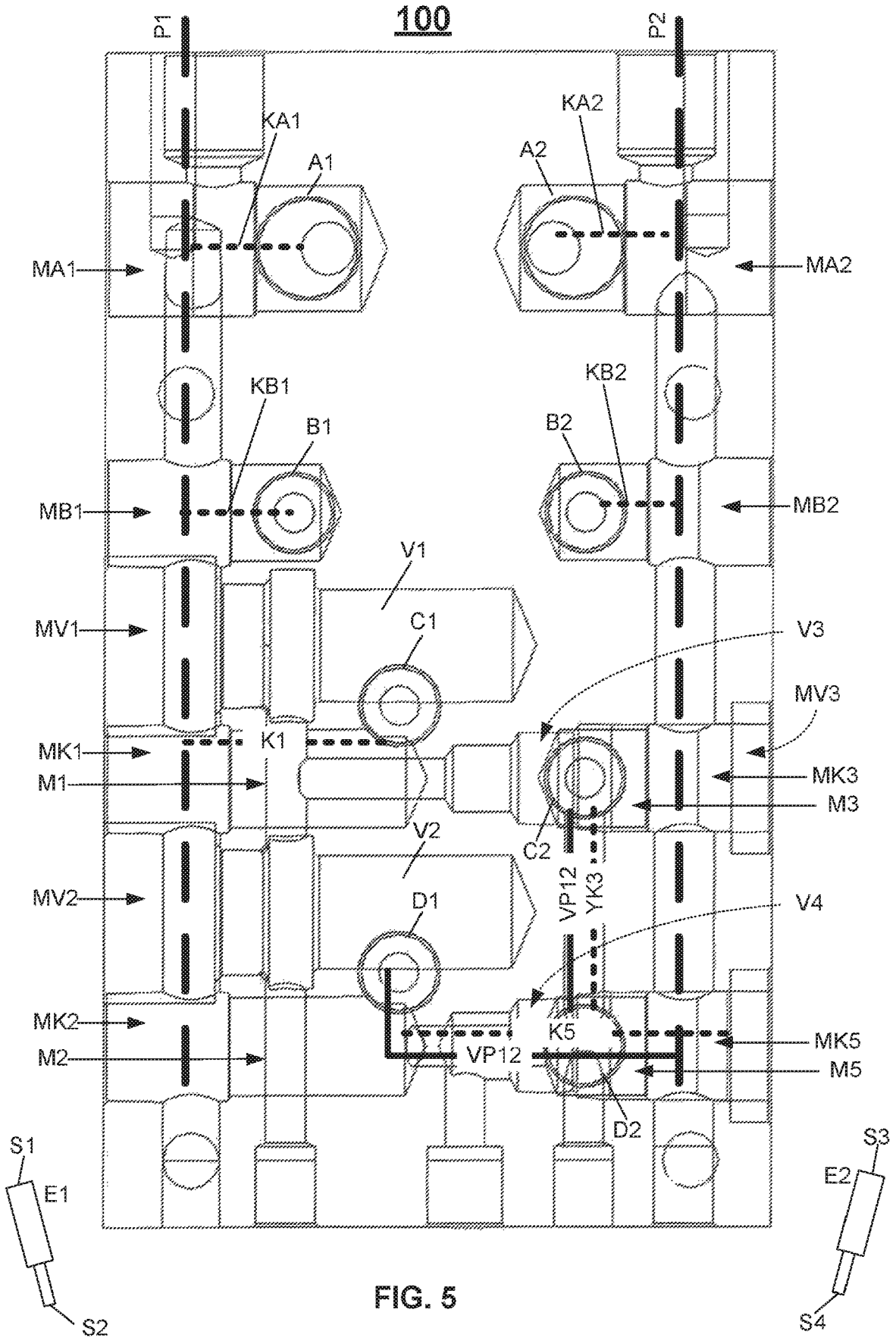
Figure 6:
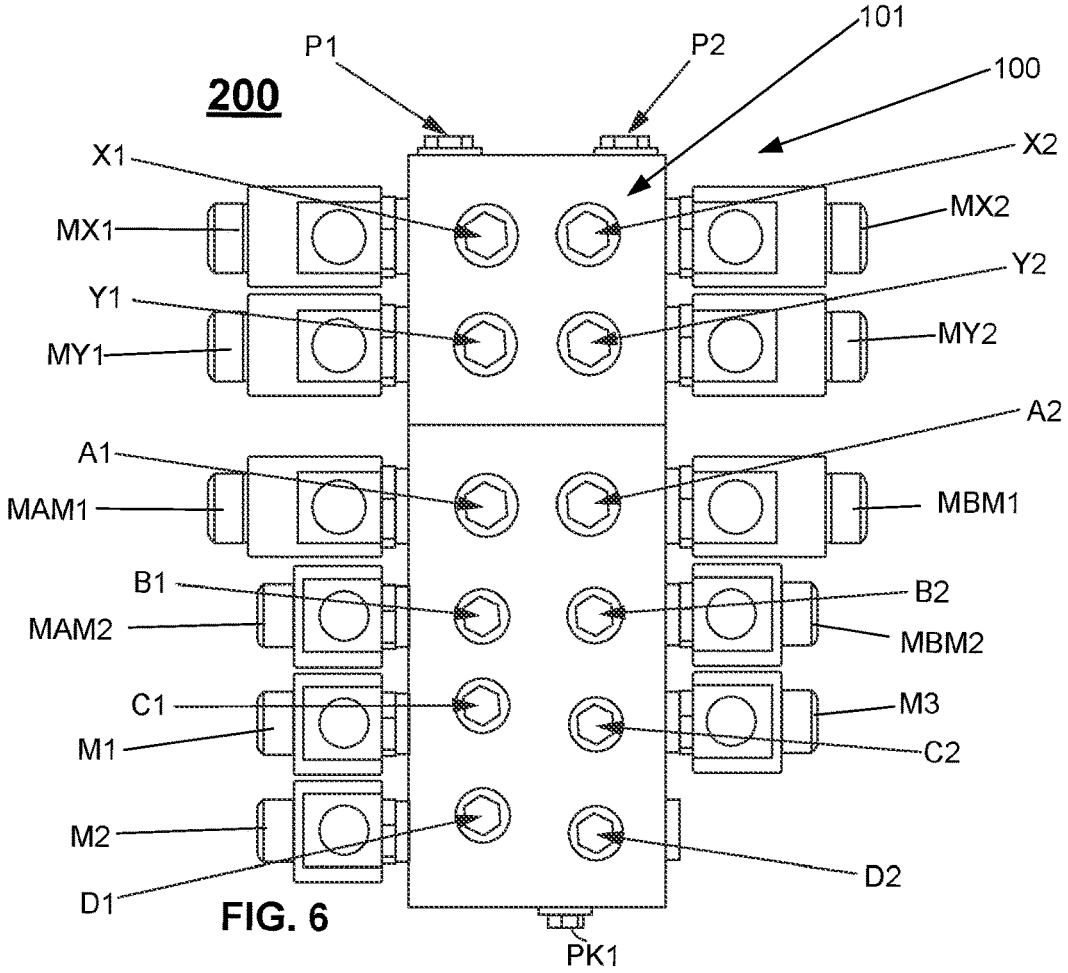
Figure 7:
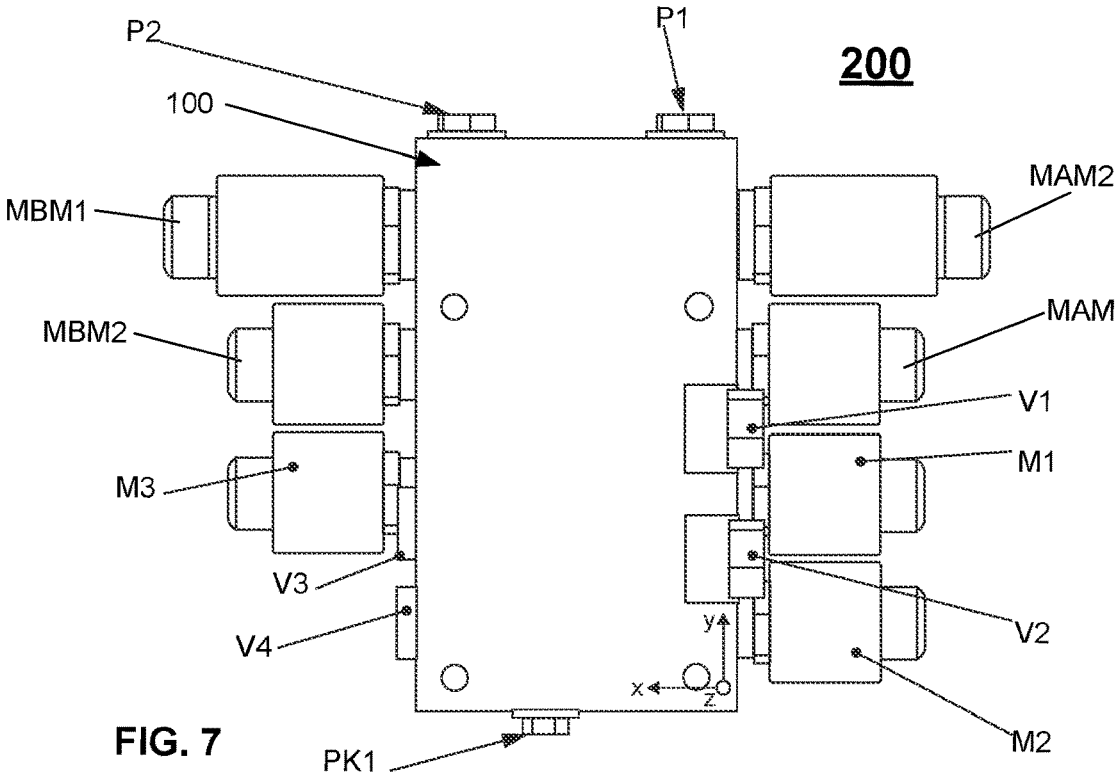

In the next section, preferred embodiments of the invention will be discussed slightly more precisely with reference to the accompanying figures, in which FIG. 1 shows one valve body according to the prior art, FIG. 2 shows one exemplary valve body and flow circuit according to one preferred embodiment of the invention, FIG. 3 shows one exemplary valve body and six different flow circuits according to one preferred embodiment of the invention, FIG. 4 shows one exemplary valve body and four different flow circuits according to one preferred embodiment of the invention, FIG. 5 shows one exemplary valve body and one twelfth flow circuit according to one preferred embodiment of the invention, FIG. 6 shows one exemplary hydraulic mechanism comprising a valve body, according to one preferred embodiment of the invention, in a view from above, and FIG. 7 shows one exemplary hydraulic mechanism comprising a valve body, according to one preferred embodiment of the invention, in a view from below.

DETAILED DESCRIPTION OF THE INVENTION

FIG. 1 has been described in the prior art section.

FIGS. 2-5 illustrate exemplary hydraulic valve bodies 100 and flow circuits according to certain preferred embodiments of the invention.

The hydraulic valve body 100 comprises two main lines P1, P2 for bringing pressurized hydraulic fluid into said body's channel system and further out of the channel system. The body comprises at least first and second outlet fittings C1, D1 for conducting hydraulic fluid from the body's channel system to actuators E1, E2, such as cylinders, for example to cylinders used for laterally controlling the drawbars of a heavy machine such as a tractor. The body further comprises respective first and second inlet fittings C2, D2 for conducting hydraulic fluid from the actuators E1, E2 back into the body's channel system and into the second main line functioning as a return channel.

The body comprises also a first channel K1 provided between the first main line P1 and the first outlet C1, a second channel K2 provided between the first main line P1 and the second outlet D1, and a third channel K3 provided between the second main line P2 and the first inlet C2. In addition, the body comprises a third connecting channel YK3 provided between the first inlet C2 and the second inlet D2. The channels and lines are preferably holes drilled in the body structure.

In connection with the first and second outlet fittings C1, D1 are provided first and second cartridge chambers MK1, MK2 for two control elements M1, M2, such as solenoid valves, operating independently of each other.

The control elements M1, M2 are used most preferably for conducting a pressure flow from the first main line P1 by way of the first or the second channel K1, K2 to at least one actuator E1, E2 connected to the first or the second inlet fitting C1, D1.

In addition, according to one embodiment, in connection with the first inlet fitting C2 is provided a third cartridge chamber MK3 for a third control element M3 working independently of the other control elements. It should be noted that, by virtue of a body structure of the invention, said third control element can be used for conducting a pressure flow in a controlled manner from the actuator E1, E2 connected either to the first and/or the second inlet fitting C2, D2 back into the second main line P2 by way of the third channel K3, or by way of the third connecting channel YK3 and the third channel K3. It is particularly notable that, by virtue of a configuration of the invention, in connection with the second inlet there is no need for a dedicated separate control element or a control channel for the same, because the pressure flow can be conducted to the third control element M3 by way of the third connecting channel YK3.

The control channels are most preferably holes, which are drilled in the body structure and can be fitted with control elements, such as solenoid valves, in a valve mechanism comprising the body structure. In the machining process, the holes are most preferably drilled from one of the facets of the body, possibly necessitating the plugging of boreholes unless the discussed hole is fitted with some element, such as an actuator, a safety valve, a control element, or something else.

According to one embodiment of the invention, between the first outlet C1 and the second outlet D1 the body is provided with a second connecting channel YK2. Moreover, in connection with the first outlet fitting C1, the body is provided with a first control channel MV1 for coupling a first pressure safety/non-return valve V1 and for controlling a pressure flow between the outlet C1 and the connecting channel YK2 and/or YK1. Also, in connection with the second outlet fitting D1 is provided a second control channel M2 for coupling a second pressure safety/non-return valve V2 for controlling a pressure flow between the outlet C2 and the connecting channel YK2 and/or YK1.

According to one embodiment, in connection with the first inlet fitting C2, the body is also provided with a third control channel MV3 for coupling a third pressure safety/non-return valve V3 and for controlling a pressure flow between the inlet C2 and the first connecting channel YK1.

In addition, according to one embodiment of the invention, in connection with the second inlet D2 is provided a fourth control channel M4 for coupling a fourth pressure safety/non-return valve V4 and for controlling a pressure flow between the second inlet D2 and the first external fitting PK1. According to one example, said first external fitting PK1 is provided in connection with the second inlet D2 and is adapted to be coupled with a (preferably external) pressure accumulator or tank, into which the overpressure of a given magnitude is able to discharge by way of the fourth pressure safety/non-return valve V4 and from which pressure accumulator, if necessary, is allowed respectively a pressure flow by way of the fourth pressure safety/non-return valve V4 into the third connecting channel YK3 and further, as described elsewhere in this document, to actuators as required by the situation.

Still furthermore, according to one embodiment of the invention, the body is provided between the second main line P2 and the second outlet D1 with a fifth channel K5. In addition, in connection with the second main line P2 is provided at least one fifth cartridge chamber MK5 for at least one fifth control element M5 working independently of the other control elements. Said fifth cartridge chamber MK5 extends into the fifth channel K5 and thereby makes possible a twelfth flow circuit from the second outlet D1 along the fifth channel K5 to the second main line P2.

According to one example, the first, second and third control channels MV1, MV2, MV3, or a portion included therein, are vertical channels and the connecting channels YK1 and YK2 can be at lower level than for example the main lines P1, P2 or the channels K1-K3. Further, according to one embodiment, the second inlet D2, or a portion included therein, is also a vertical channel.

First Flow Circuit (VP1) for Enabling a First Function (E1, Operation of the Left-Hand Cylinder) (FIG. 3)

According to one example, the first flow circuit VP1 for enabling a first function comprises a first outlet C1 and a first inlet C2. The first outlet C1 is adapted to be connected onto a first side S1 (piston side) of the first actuator E1 for conducting a pressure flow from the first main line P1 by way of a first channel K1 onto the first side S1 of the first actuator E1. The first inlet C2, on the other hand, is adapted to be connected onto a second side S2 (left-hand side) of the same first actuator E1 for conducting a pressure flow by way of a third channel K3 to the second main line P2.

In operation (operation of the left-hand cylinder E1), the control elements M1 and M3 of a hydraulic mechanism (FIG. 5) are opened, whereby M1 opens a line from the main line P1 to the outlet C1 and M3 opens a line from the inlet C2 to the main line (return) P2.

Second Flow Circuit (VP2) for Enabling a Second Function (E2, Operation of the Right-Hand Cylinder) (FIG. 3)

According to one example, the second flow circuit VP2 for enabling a second function comprises a second outlet D1 and a second inlet D2. The second outlet D1 is adapted to be connected onto a first side S3 (piston side) of the second actuator E2 for conducting a pressure flow from the first main line P1 by way of a second channel K2 onto the first side S3 of the second actuator E2. The second inlet D2 is adapted to be connected onto a second side S4 (rod side) of the second actuator E2 for conducting a pressure flow by way of a third connecting channel YK3 and a third channel K3 into the second main line P2.

In operation (operation of the right-hand cylinder E2), the control elements M2 and M3 of a hydraulic mechanism (FIG. 5) are opened, whereby M2 opens a line from the main line P1 to the outlet D1 and M3 opens a line from C2 to the main line (return) P2, the pressure flow being thus able to flow from the inlet D2 by way of the connecting channel YK3 to the main line (return) P2.

Third Flow Circuit (VP3) for Enabling a Third Function (Floating Position) (FIG. 2)

According to one example, the third flow circuit VP3 for enabling a third function (for example the "floating position" of a soil working plough) comprises both first, second and third channels K1, K2, K3, a third connecting channel YK3, as well as first and second outlets C1, D1 and first and second inlets C2, D2. The outlets and inlets are adapted to be connected (at least partially integral with each other in functional sense) to the first and the second actuators E1, E2.

In the third flow circuit configuration, the pressure applied onto the first sides S1, S3 of the first and second actuators E1, E2 is adapted to shift freely by way of the first and second outlets C1, D1, as well as by way of the first and second channels K1, K2 connecting the same, and by way of the first main channel P1, from side to side (C1↔D1). In addition, the pressure applied onto the second sides S2, S4 of the first and second actuators E1, E2 is adapted to shift freely by way of the first and second inlets C2, D2, as well as by way of the third connecting channel YK3 connecting the same, from side to side (C2↔D2).

In operation (operation of both cylinders E1, E2, "floating position"), the control elements M1 and M2 of a hydraulic mechanism (FIG. 5) are opened, whereby M1 opens a line from the main line P1 to the outlet C1 and M2 opens a line from the main line P1 to the outlet D1, the pressure flow being allowed to flow freely between the outlets C1 and D1 by way of the main line P1 (the line from the piston side of E1 to the piston side of E2 is open). Likewise, the operation involves opening the hydraulic mechanism control element M3, whereby M3 opens a line between the inlets C2 and D2 by way of the connecting channel YK3 (the line from the rod side of E1 to the rod side of E2 is open).

Fourth Flow Circuit (VP4) for Enabling a Fourth Function (Pressure Equalization of the Piston Side of E1 onto the Rod Side of E1) (FIG. 3)

According to one example, the fourth flow circuit VP4 for enabling a fourth function comprises a first outlet C1 and a first inlet C2, as well as a first connecting channel K1 provided therebetween, as well as between the first connecting channel YK1 and the first outlet C1 a first control channel MV1 and therein a first pressure safety/non-return valve V1. The first outlet C1 is adapted to be connected onto a first side S1 (piston side) of the first actuator E1 for conducting an overpressure generated on the first side of the actuator E1 along the first connecting channel YK1 to the first inlet C2. The first inlet C2 is adapted to be connected onto a second side S2 of the first actuator E1 and thereby to primarily enable the overpressure conducted along the first connecting channel YK1 to be equalized onto the second side S2 (rod side) of the first actuator E1.

In operation, the overpressure is required to exceed a pressure value (for example 160 bar) of the first pressure safety/non-return valve V1 and to advance over a third non-return valve V3 to the first inlet. In operation, the control elements are closed.

Fifth Flow Circuit VP5 for Enabling a Fifth Function (Pressure Equalization of the Piston Side of E1 into an External Channel PK1 and into a Pressure Accumulator or Tank Possibly Integrated Therewith) (FIG. 3)

The fifth flow circuit VP5 for enabling a fifth function comprises a first outlet C1 and a first inlet C2, as well as a first connecting channel YK1 provided therebetween, as well as between the first connecting channel YK1 and the first outlet C1 a first control channel MV1 and therein a first pressure safety/non-return valve V1. It further comprises a third control channel MV3 provided in connection with the first inlet fitting C2 for coupling a third pressure safety/non-return valve V3 and for conducting a pressure flow from the first connecting channel YK1 to the first inlet C2 and further into a third connecting channel YK3 provided between the first and the second inlets C2, D2.

In addition, the fifth flow circuit VP5 comprises a first external channel PK1, which is provided in connection with the third connecting channel YK3 and/or the second inlet D2 and which is adapted to be connected for example to a pressure accumulator or tank. In addition, the first outlet C1 is adapted to be connected onto a first side S1 (piston side) of the first actuator E1 for conducting an overpressure generated on the first side of the actuator E1 along the first connecting channel YK1 and the third connecting channel YK3 by way of the third pressure safety/non-return valve V3 to the first inlet C2 and further by way of the third connecting channel YK3 to the second inlet D2 and, by way of a fourth connecting channel YK4 provided in connection therewith and by way of a fourth pressure safety/non-return valve V4, into the first external channel PK1.

In operation, the overpressure must exceed a pressure value (for example 160 bar) of the first pressure safety/non-return valve V1 and a pressure value (for example 175 bar) of the fourth pressure safety/non-return valve V4. If the first external channel PK1 is connected to a pressure accumulator, the pressure accumulator may have a threshold pressure for example of 150 bar. In operation, the valves are closed.

Sixth Flow Circuit VP6 for Enabling a Sixth Function (Equalization of the Piston Side Underpressure of E1 from the Rod Side) (FIG. 3)

The sixth flow circuit VP6 for enabling a sixth function comprises a first outlet C1 and a first inlet C2, as well as a first connecting channel YK1 which is connected at its first end to the first outlet C1 by way of a first control channel MV1 and a first pressure safety/non-return valve V1 and at its second end connected to the first inlet C2 by way of a third control channel MV3 and a third pressure safety/non-return valve V3.

The first outlet C1 is adapted to be connected onto a first side S1 (piston side) of the first actuator E1 and the first inlet C2 is adapted to be connected onto a second side S2 (rod side) of the first actuator E1.

In order to enable the equalization of an underpressure generated on the first side S1 of the first actuator E1, the first outlet C1 is adapted to conduct a pressure flow from the second side S2 of the first actuator E1 by way of the first inlet C2 into the third control channel MV3 and over the third pressure safety/non-return valve V3 and further along the first connecting channel YK1 into the first control channel MV1 and over the first pressure safety/non-return valve V1 and further by way of the first outlet C1 onto the first side S1 of the first actuator E1.

In operation, the pressure flow is required to exceed a pressure value (for example 130 bar) of the third pressure safety/non-return valve V3. In operation, the valves are closed.

Seventh Flow Circuit VP7 for Enabling a Seventh Function (Equalization of the Piston Side Underpressure of E1 from an External Channel PK1 and Especially from a Pressure Accumulator Integrated Therewith) (FIG. 3)

The seventh flow circuit VP7 for enabling a seventh function comprises a first outlet C1 and a first external channel PK1, as well as a first connecting channel YK1 which is at its first end connected to the first outlet C1 by way of a first control channel MV1 and a first pressure safety/non-return valve V1 and at its second end connected to the first inlet C2 by way of a third control channel MV3 and a third pressure safety/non-return valve V3, as well as a third connecting channel YK3 provided between the first inlet C2 and the second inlet D2 and a fourth control channel MV4 provided between the second inlet D2 and the first external channel PK1 and by way of a fourth pressure safety/non-return valve V4.

The first outlet C1 is adapted to be connected onto a first side S1 (piston side) of the first actuator E1.

In order to enable the equalization of an underpressure generated on the first side S1 of the first actuator E1, the first outlet C1 is adapted to conduct a pressure flow from the first external channel PK1 along the fourth control channel MV4 to the first outlet C1 by way of the fourth pressure safety/non-return valve V4, the first inlet C2, the third connecting channel YK3, the second inlet D2, the third control channel MV3, the third pressure safety/non-return valve V3, and further by way of the first connecting channel YK1 and the first pressure safety/non-return valve V1.

In operation, the pressure flow must exceed a pressure value (for example 130 bar) of the third pressure safety/non-return valve V3. In operation, the valves are closed.

Eighth Flow Circuit VP8 for Enabling a Eighth Function (Equalization of the Piston Pressure of E2 onto the Rod Side) (FIG. 4)

In the eighth flow circuit configuration, the body comprises a second outlet D1 and a first inlet C2, as well as a first connecting channel YK1 provided therebetween and a second connecting channel YK2 provided between the second outlet D1 and the first connecting channel YK1. The second outlet D1 connects with the second connecting channel YK2 by way of a second control channel MV2 and a second pressure safety/non-return valve V2. The first connecting channel YK1 connects with the first inlet C2 by way of a third control channel MV3 and a third pressure safety/non-return valve V3. The configuration comprises a second inlet D2 which connects with the first inlet C2 by way of a third connecting channel YK3.

The eighth flow circuit VP8 comprises the second outlet D1 and the second inlet D2, and wherein the second outlet D1 is adapted to be connected onto a first side S3 (piston side) of the second actuator E2 for conducting an overpressure generated on the first side of the actuator E2 over the second control channel MV2 and the second pressure safety/non-return valve V2 and along the second connecting channel YK2 into the first connecting channel YK1 and further by way of the third control channel MV3 and the third pressure safety/non-return valve V3 to the first inlet C2 and along the third connecting channel YK3 to the second inlet D2, said second inlet D2 being adapted to be connected onto a second side S4 (rod side) of the second actuator E2 and to primarily enable thereby the overpressure generated on the first side S3 of the second actuator E2 to be equalized onto the second side S4 of the second actuator E2.

In operation, the overpressure must exceed a pressure value (for example 160 bar) of the second pressure safety/non-return valve V2. In operation, the valves are closed.

Ninth Flow Circuit VP9 for Enabling a Ninth Function (Equalization of the Piston Overpressure of E2 into an External Channel PK1 or a Pressure Accumulator) (FIG. 4)

In the ninth flow circuit configuration, the body comprises a second outlet D1 and a first inlet C2, as well as a first connecting channel YK1 provided therebetween and a second connecting channel YK2 provided between the second outlet D1 and the first connecting channel YK1. The second outlet D1 connects with the second connecting channel YK2 by way of a second control channel MV2 and a second pressure safety/non-return valve V2 and the first connecting channel YK1 connects with the first inlet C2 by way of a third control channel MV3 and a third pressure safety/non-return valve V3. The configuration comprises also a second inlet D2 connecting with the first inlet C2 by way of a third connecting channel YK3, as well as a first external channel PK1 connecting with the second inlet D2 by way of a fourth control channel MV4 and a fourth pressure safety/non-return valve V4.

The ninth flow circuit comprises the second outlet D1 and the first external channel PK1, wherein the second outlet D1 is adapted to be connected onto a first side S3 (piston side) of the second actuator E2 for conducting an overpressure generated on the first side of the actuator E2 over the second control channel MV2 and the second pressure safety/non-return valve V2 and along the second connecting channel YK2 into the first connecting channel YK1 and further by way of the third control channel MV3 and the third pressure safety/non-return valve V3 to the first inlet C2 and along the third connecting channel YK3 to the second inlet D2 and further into the first external channel PK1 by way of the fourth control channel MV4 and the fourth pressure safety/non-return valve V4.

In operation, the overpressure is required to exceed a pressure value (for example 160 bar) of the second pressure safety/non-return valve V2 and a pressure value (for example 175 bar) of the fourth pressure safety/non-return valve V4. If the first external channel PK1 is connected to a pressure accumulator, the pressure accumulator may have a threshold pressure for example of 150 bar. In operation, the valves are closed.

Tenth Flow Circuit VP10 for Enabling a Tenth Function (Equalization of the Piston Side Underpressure of E2 onto the Rod Side) (FIG. 4)

The tenth flow circuit VP10 comprises a second outlet D1 and a first inlet C2, as well as a first connecting channel YK1 provided therebetween and a second connecting channel YK2 provided between the second outlet D1 and the first connecting channel YK1, wherein the second outlet D1 connects with the second connecting channel YK2 by way of a second control channel MV2 and a second pressure safety/non-return valve V2 and wherein the first connecting channel YK1 connects with the first inlet C2 by way of a third control channel MV3 and a third pressure safety/non-return valve V3. In addition, the flow circuit comprises a second inlet D2 connecting with the first inlet C2 by way of a third connecting channel YK3.

The second outlet D1 is adapted to be connected onto a first side S3 (piston side) of the second actuator E2 and the second inlet D2 is adapted to be connected onto a second side S4 (rod side) of the second actuator E2. In order to enable the equalization of an underpressure generated on the first side S3 of the second actuator E2, the second outlet D1 is adapted to conduct a pressure flow from the second side S4 of the second actuator E2 by way of the second inlet D2 along the third connecting channel YK3 to the first inlet C2 and over the third connecting channel YK3 and the third pressure safety/non-return valve V3 and further along the first connecting channel YK1 into the second connecting channel YK2 and further onto the first side S3 of the second actuator E2 over the second control channel MV2 and the second pressure safety/non-return valve V2 and further by way of the second outlet C2.

In operation, the overpressure is required to exceed a pressure value (for example 130 bar) of the third pressure safety/non-return valve V3. In operation, the valves are closed.

Eleventh Flow Circuit VP11 for Enabling an Eleventh Function (Equalization of the Piston Side Underpressure of E2 from an External Channel PK1 and Especially from a Pressure Accumulator Integrated Therewith) (FIG. 4)

The eleventh flow circuit VP11 comprises a second outlet D1 and a first external channel PK1, as well as a first connecting channel YK1 provided between the second outlet D1 and the first inlet C2 and a second connecting channel YK2 provided between the second outlet D1 and the first connecting channel YK1. The second outlet D1 connects with the second connecting channel YK2 by way of a second control channel MV2 and a second pressure safety/non-return valve V2, and the first connecting channel YK1 connects with the first inlet C2 by way of a third control channel MV3 and a third pressure safety/non-return valve V3, as well as a second inlet D2 which connects with the first inlet C2 by way of a third connecting channel YK3, and moreover a fourth control channel MV4 provided between the second inlet D2 and the first external channel PK1, and a fourth pressure safety/non-return valve V4.

The second outlet D1 is adapted to be connected onto a first side S3 (piston side) of the second actuator E2. In order to enable the equalization of an underpressure generated on the first side S3 of the second actuator E2, the second outlet D1 is adapted to conduct a pressure flow from the first external channel PK1 to the second outlet D1 over the fourth control channel MV4 and the fourth pressure safety/non-return valve V4 and by way of the second inlet D2 into the third connecting channel YK3 and by way of the first inlet C2 and the third control channel MV3 and the third pressure safety/non-return valve V3 further into the first connecting channel YK1, into the second connecting channel YK2, and further to the second outlet D1 by way of the second control channel MV2 and the second pressure safety/non-return valve V2.

In operation, the pressure flow is required to exceed a pressure value (for example 130 bar) of the third pressure safety/non-return valve V3. In operation, the valves are closed.

Twelfth Flow Circuit (VP12) for Enabling a Twelfth Function (a Reverse Function of Actuators E1 and E2, i.e. for Example a Function in which the Actuator's E1 First Side or Piston Goes in and the Actuator's E2 First Side or Piston Comes Out) (FIG. 5)

The twelfth flow circuit VP12 for enabling a twelfth function comprises first and second outlets C1, D1 and first and second inlets C2, D2, as well as both a third connecting channel YK3 provided between the first and second inlets C2, D2 and a fifth channel K5 provided between the second outlet D1 and the second main line P2. The second outlet D1 connects with the fifth channel K5 and further with the second main line P2 by way of a fifth cartridge chamber MK5 and a fifth control element M5 to be fitted thereto.

In the twelfth flow circuit, in order to enable the twelfth function, the first outlet C1 is adapted to be connected onto a first side S1 of the first actuator E1 for conducting a pressure flow from the first main line P1 by way of a first channel K1 onto the first side S1 (piston side) of the first actuator E1. In addition, the first inlet C2 is adapted to be connected onto a second side S2 (rod side) of the first actuator E1 for conducting a pressure flow by way of a third connecting channel YK3 to the second inlet fitting D2. The second inlet fitting D2 is adapted in the twelfth flow circuit VP12 to be connected onto a second side S4 (rod side) of the second actuator E2 for conducting a pressure flow from the inlet fitting D2 onto the second side S4 of the second actuator E2. In addition, the second outlet D1 is adapted to be connected onto a first side (piston side) of the second actuator E2 and further for conducting a pressure flow from the first side S3 of the second actuator E2 into the fifth channel K5 associated with the first outlet D1. Said fifth channel K5 is adapted to conduct said pressure flow into the second main line P2.

The operation (concurrent operation of cylinders E1, E2) involves the opening of control elements M1 and M5 in a hydraulic mechanism (FIG. 5), whereby M1 opens a line from the main line P1 to the outlet C1, and M5 opens a line from the inlet D1 to the main line (return) P2. In an exemplary operation, the cylinders can be coupled for example with the drawbars of a heavy machine, wherein, by controlling the control elements M1 and M2, the drawbars can be concurrently moved either left or right (depending on whether the flow pressure is introduced into the main line P1 as in the present case, or into the main line P2 with the flow in a reverse direction, which is also possible).

According to one preferred embodiment of the invention, the hydraulic valve body further comprises at least third, most preferably also fourth outlets (B1, A1) and respective inlets (B2, A2). The body also comprises channels (KB1, KB2, KA1, KA2) provided in the body between the first main line (P1) and the outlets (B1, A1) as well as between the second main line (P2) and the inlets (B2, A2), as well as cartridge chambers (MB1, MB2, MA1, MA2) fitted in connection therewith for control elements (MAM1, MAM2, MBM1, MBM2) operating independently of each other for conducting a pressure flow from the first main line (P1) to at least one outlet fitting (B1, A1) by way of either channel (KB1, KA1) and for conducting a pressure flow into the second main line (P2) from at least one inlet fitting (B2, A2) by way of the channel (KB2, KA2).

According to one preferred embodiment of the invention, the hydraulic valve body is adapted to be coupled with an additional body module 101 (FIG. 5), wherein the additional body module comprises at least one additional outlet (X1, Y1) and at least one respective additional inlet (X2, Y2), as well as respective channels (KX1, KY1, KX2, KY2, not shown in the figures) between the main lines and the outlets and inlets, as well as respective cartridge chambers (not shown in the figures) for control elements MX1, MX2, MY1, MY2.

FIG. 5 shows one exemplary hydraulic mechanism 200 comprising the valve body 100 in accordance with one preferred embodiment of the invention, in a view from above, and FIG. 6 one exemplary hydraulic mechanism 200 comprising the valve body 100, in a view from below.

The control element is most preferably a seat type solenoid valve, which also functions at the same time as a lock and is practically leak-proof.

The above description has only presented a few embodiments for a solution of the invention. The principle according to the invention can naturally be varied within the scope of protection defined by the claims, regarding for example implementation details and fields of use. In particular, it should be noted that said couplings of the body's inlets can of course be made independently of the body to any actuator or actuator outlet and those presented above are mere examples. In addition, the body's inlets, outlets, lines and channels, for example the first external channel PK1, are depicted in the figures at certain locations, but it should be appreciated that these may naturally be located elsewhere in the body, nor are these by any means confined in said locations of the body by the invention and claims. Moreover, for example the cartridge chamber is most preferably implemented as a bore (cartridge bore or spindle bore, for example a solenoid valve cartridge bore or spindle bore).

It is further notable that the body of the invention along with its functions can be most preferably implemented with three control elements, but is should be appreciated that, alternatively (or additionally), in connection with the second inlet D2 can also be provided a fourth cartridge chamber (MK4, FIG. 3) for a fourth control element (M4, FIG. 3) working independently of the other control elements for conducting a pressure flow from the actuator (E2) coupled with the second inlet fitting (D2) back into the second main line (P2). In this case, the solution would have the body provided also with a fourth channel (K4, FIG. 3) between the second main line (P2) and the second inlet (D2), whereby the third connecting channel (YK3) provided in the body between the first inlet (C2) and the second inlet (D2) would not be absolutely necessary because, for example in a floating position, the flow circuit VP3 between the first inlet (C2) and the second inlet (D2) could be arranged by way of the second pressure line (P2) (VP3' in FIG. 3) (in a corresponding manner and analogously to the way that VP3 circles by way of the first pressure line (P1) between the first outlet (C1) and the second outlet (D1)). In practice, the fourth channel (K4), the fourth control element (M4), as well as the optional third flow circuit VP3' are unnecessary as the functions can be carried out e.g. by using the third connecting channel (YK3) and with fewer accessories (e.g. a fourth valve) as described elsewhere in this document.

It should still further be noted that the third connecting channel (YK3) makes possible a flexible discharge of pressure shocks, which would not be possible should the body or the mechanism only include the control elements M3 and M4, which are closed in the pressure shock situation. Thus, the pressure shock would not be able to discharge along the optional third flow circuit VP3' (by way of the main line P2).

Still further, according to one optional embodiment, the first connecting channel (YK1) can be provided as such a large (extensive) conduit that no separate cross-boring, i.e. in other words no separate second connecting channel (yk2), is needed. Hence, it is to be appreciated that, although a separate second connecting channel (YK2) is discussed in this document, this can be implemented solely with a first connecting channel (YK1) whenever the latter reaches the pertinent objects such as for example fittings and channels.

What is claimed is:

1. A hydraulic valve body, comprising two main lines (P1, P2) for bringing pressurized hydraulic fluid into a channel system of said body and further out of the channel system, the body comprising at least a first and a second outlet (C1, D1) for conducting hydraulic fluid from the body's channel system to actuators (E1, E2), and two respective inlets (C2, D2) for conducting hydraulic fluid from the actuators (E1, E2) back into the body's channel system, wherein the body is adapted to be configured for at least three different operating modes, the modes comprising at least three different channel constructions so that between the first main line (P1) and the first outlet (C1) the body is provided with a first channel (K1), between the first main line (P1) and the second outlet (D1) the body is provided with a second channel (K2), between the second main line (P2) and the first inlet (C2) the body is provided with a third channel (K3), and further between the first inlet (C2) and the second inlet (D2) the body is provided with a connecting channel (YK3), or between the second main line (P2) and the second inlet (D2) the body is provided with a fourth channel (K4), and wherein the body is further provided, in connection with two of said outlets (C1, D1), with a first and a second cartridge chamber (MK1, MK2) for two control valves (M1, M2) operating independently of each other for conducting by way of the first or second channels (K1, K2) a pressure flow from the first main line (P1) to at least one actuator (E1, E2) coupled with at least one of the outlets (C1, D1), and in connection with at least one of said inlets (C2, D2), with at least one third cartridge chamber (MK3) for at least one third control valve (M3) operating independently of the other control valves for conducting a pressure flow from the at least one actuator (E1, E2) connected to at least one of the inlets (C2, D2) back into the second main line (P2)

by way of the third channel (K3), by way of the connecting channel (YK3) and the third channel (K3), or by way of the fourth channel (K4), wherein a first flow circuit (VP1) for enabling a first function comprises the first outlet (C1) and the first inlet (C2), wherein the first outlet (C1) is adapted to be connected onto a first side (S1) of the first actuator (E1) for conducting a pressure flow from the first main line (P1) by way of the first channel (K1) onto the first side (S1) of the first actuator (E1), and the first inlet (C2) is adapted to be connected onto a second side (S2) of the first actuator (E1) for conducting a pressure flow by way of the third channel (K3) into the second main line (P2), and a second flow circuit (VP2) for enabling a second function comprises the second outlet (D1) and the second inlet (D2), wherein the second outlet (D1) is adapted to be connected onto a second side (S3) of the second actuator (E2) for conducting a pressure flow from the first main line (P1) by way of the second channel (K2) onto the first side (S3) of the second actuator (E2), and the second inlet (D2) is adapted to be connected onto a second side (S4) of the second actuator (E2) for conducting a pressure flow by way of the third connecting channel (YK3) and the third channel (K3) into the second main line (P2), and wherein the body is further provided with a fifth channel (K5) between the second main line (P2) and the second outlet (D1), and in connection with the second main line (P2) is provided at least one additional cartridge chamber (MK5) for at least one additional control valve (M5) operating independently of the other control valves, said additional cartridge chamber (MK5) extending into the fifth channel (K5) and enables thereby an additional flow circuit (VP12) from the second outlet (D1) along the fifth channel (K5) to the second main line (P2), and wherein the additional flow circuit (VP12) for enabling an additional function comprises the first outlet (C1) and the first inlet (C2), wherein the first outlet (C1) is adapted to be connected onto the first side (S1) of the first actuator (E1) for conducting a pressure flow from the first main line (P1) by way of the first channel (K1) onto the first side (S1) of the first actuator (E1), and the first inlet (C2) is adapted to be connected onto the second side (S2) of the first actuator (E1) for conducting a pressure flow by way of the connecting channel (YK3) to the second inlet (D2) which is adapted to be connected onto the second side (S4) of the second actuator (E2) for conducting a pressure flow from the inlet fitting (D2) onto the second side (S4) of the second actuator (E2), and wherein the second inlet (D1) is adapted to be connected onto the first side (S3) of the second actuator (E2) and further for conducting a pressure flow from the first side (S3) of the second actuator (E2) into the fifth channel (K5) connecting with the second inlet (D1) and further along the fifth channel (5) into the second main line (P2), thereby adapting said body to enable the execution of at least three different functions with said actuators.

2. The body according to claim 1, wherein a third flow circuit (VP3) for enabling a third function comprises both the first, second and the third channels (K1, K2, K3), the connecting channel (YK3), as well as the first and second outlets (C1, D1), and the first and second inlets (C2, D2) which are adapted to be connected to the first and the second actuators (E1, E2), whereby the pressure applied onto the first sides (S1, S3) of the first and second actuators (E1, E2) is adapted to shift by way of the first and second outlets (C1, D1), as well as by way of the first and second channels (K1, K2) connecting the same, and by way of the first main channel P1; and the pressure applied onto the second sides (S2, S4) of the first and second actuators (E1, E2) is adapted to shift freely by way of the first and second inlets (C2, D2), as well as by way of the connecting channel (YK3) connecting the same.

3. The body according to claim 1, wherein between the first outlet (C1) and the second outlet (D1) the body is provided with a second connecting channel (YK2), and wherein, in connection with the first outlet (C1), the body is further provided with a first control channel (MV1) for coupling a first pressure non-return valve (V1) and for controlling a pressure flow between the outlet (C1) and the second connecting channel (YK2), as well as in connection with the second outlet (D1), with a second control channel (MV2) for coupling a second pressure non-return valve (V2) and for controlling a pressure flow between the second outlet (D1) and the second connecting channel (YK2).

4. The body according to claim 3, wherein, in connection with the first inlet (C2), the body is provided with a third control channel (MV3) for coupling a pressure non-return valve (V3) and for controlling a pressure flow between the first inlet (C2) and an additional connecting channel (YK1).

5. The body according claim 4, wherein in connection with the second inlet (D2) is provided a fourth control channel (MV4) for coupling a fourth pressure equalization valve (V4) and for controlling a pressure flow between the second inlet (D2) or a first external fitting (PK1) provided in connection with the second inlet (C2).

6. The body according to claim 1, wherein the body comprises a first external fitting (PK1), which is provided in connection with the second inlet (D2) and which is adapted to be connected to a pressure accumulator or tank.

7. The body according to claim 4, wherein the body comprises the additional connecting channel (YK1) provided between the first outlet (C1) and the first inlet (C2), and wherein an additional flow circuit (VP4) for enabling an additional function comprises the first outlet (C1) and the first inlet (C2) as well as the additional first connecting channel (YK1) provided therebetween, and wherein the first outlet (C1) is adapted to be connected onto the first side (S1) of the first actuator (E1) for conducting an overpressure generated on the first side of the first actuator (E1) along the additional connecting channel (YK1) to the first inlet (C2), said first inlet (C2) being adapted to be connected onto the second side (S2) of the first actuator (E1) and to thereby primarily equalize the overpressure, conducted along the additional connecting channel (YK1), onto the second side (S2) of the first actuator (E1).

8. The body according to claim 4 comprising an additional flow circuit (VP5) for enabling an additional function, the additional flow circuit (VP5) comprising:

the first outlet (C1) and the first inlet (C2) as well as the additional connecting channel (YK1) provided therebetween, the third control channel (MV3) provided in connection with the first inlet (C2) for conducting a pressure flow from the additional connecting channel (YK1) to the first inlet (C2), as well as into the connecting channel (YK3) provided between the first and second inlets (C2, D2), as well as the first external fitting (PK1), which is provided in connection with the connecting channel (YK3) or the second inlet (D2) and which is adapted to be connected to a pressure accumulator or tank, and wherein the first outlet (C1) is adapted to be connected onto the first side (S1) of the first actuator (E1) for conducting an overpressure generated on the first side of the first actuator (E1) along the additional connecting channel (YK1) and the third control channel (MV3) to the first inlet (C2) and further by way of the connecting channel (YK3) to the second inlet (D2), and by way of a fourth control channel (MV4), provided in connection therewith, into the first external fitting (PK1), and wherein the first outlet (C1) is adapted to be connected onto the first side (S1) of the first actuator (E1) for conducting an overpressure generated on the first side of the actuator (E1) along the additional connecting channel (YK1) to the first inlet (C2) and further by way of the third control channel (MV3) and the connecting channel (YK3) to the second inlet (D2) and further by way of the fourth control channel (MV4), provided in connection therewith, into the first external fitting (PK1).

9. The body according to claim 4 comprising an additional flow circuit (VP6) for enabling an additional function, the additional flow circuit (VP6) comprising:

the first outlet (C1) and the first inlet (C2), as well as the additional connecting channel (YK1) which is connected at its first end to the first outlet (C1) by way of the first control channel (MV1) and at its second end connected to the first inlet (C2) by way of the third control channel (MV3), and wherein the first outlet (C1) is adapted to be connected onto the first side (S1) of the first actuator (E1) and the first inlet (C2) is adapted to be connected onto the second side (S2) of the first actuator (E1), and in order to enable the equalization of an underpressure generated on the first side (S1) of the first actuator (E1), the first outlet (C1) is adapted to conduct a pressure flow from the second side (S2) of the first actuator (E1) by way of the first inlet (C2) into the third control channel (MV3) and further along the additional connecting channel (YK1) into the first control channel (MV1) and further by way of the first outlet (C1) onto the first side (S1) of the first actuator (E1).

10. The body according to claim 5, comprising an additional flow circuit (VP7) for enabling an additional function, the additional flow circuit (VP7) comprising:

the first outlet (C1) and the first external fitting (PK1), as well as the additional connecting channel (YK1) which is at its first end connected to the first outlet (C1) by way of the first control channel (MV1) and at its second end connected to the first inlet (C2) by way of the third control channel (MV3), as well as the connecting channel (YK3) provided between the first inlet (C2) and the second inlet (D2) and the fourth control channel (MV4) provided between the second inlet (D2) and the first external fitting (PK1), and wherein the first outlet (C1) is adapted to be connected onto the first side (S1) of the first actuator (E1), and in order to enable the equalization of an underpressure generated on the first side (S1) of the first actuator (E1), the first outlet (C1) is adapted to conduct a pressure flow from the first external channel (PK1) along the fourth control fitting (MV4) to the first outlet (C1) by way of the first inlet (C2), the connecting channel (YK3), the second inlet (D2), the third control channel (MV3), and further by way of the additional connecting channel (YK1).

11. The body according to claim 4, wherein the body comprises:

the second outlet (D1) and the first inlet (C2), as well as the additional connecting channel (YK1) provided therebetween and the second connecting channel (YK2) provided between the second outlet (D1) and the additional connecting channel (YK1), wherein the second outlet (D1) connects with the second connecting channel (YK2) by way of the second control channel (MV2) and wherein the additional connecting channel (YK1) connects with the first inlet (C2) by way of the third control channel (MV3), as well as the second inlet (D2) connecting with the first inlet (C2) by way of the connecting channel (YK3), and wherein an additional flow circuit (VP8) for enabling an additional function comprises the second outlet (D1) and the second inlet (D2), and wherein the second outlet (D1) is adapted to be connected onto the first side (S3) of the second actuator (E2) for conducting an overpressure generated on the first side of the actuator (E2) along the second control channel (MV2) and the second connecting channel (YK2) into the first connecting channel (YK1) and further by way of the third control channel (MV3) to the first inlet (C2) and along the connecting channel (YK3) to the second inlet (D2), said second inlet (D2) being adapted to be connected onto the second side (S4) of the second actuator (E2) and to primarily enable thereby the overpressure generated on the first side (S3) of the second actuator (E2) to be equalized onto the second side (S4) of the second actuator (E2).

12. The body according to claim 5, wherein the body comprises:

the second outlet (D1) and the first inlet (C2), as well as the additional connecting channel (YK1) provided therebetween and the second connecting channel (YK2) provided between the second outlet (D1) and the first connecting channel (YK1), wherein the second outlet (D1) connects with the second connecting channel (YK2) by way of the second control channel (MV2) and wherein the first connecting channel (YK1) connects with the first inlet (C2) by way of the third control channel (MV3), as well as the second inlet (D2) connecting with the first inlet (C2) by way of the third connecting channel (YK3), as well as the first external fitting (PK1) connecting with the second inlet (D2) by way of the fourth control channel (MV4), and wherein an additional ninth flow circuit (VP9) for enabling an additional function comprises the second outlet (D1) and the first external fitting (PK1), and wherein the second outlet (D1) is adapted to be connected onto the first side (S3) of the second actuator (E2) for conducting an overpressure generated on the first side of the actuator (E2) along the second control channel (MV2) and the second connecting channel (YK2) into the additional connecting channel (YK1) and further by way of the third control channel (MV3) to the first inlet (C2) and along the connecting channel (YK3) to the second inlet (D2) and further into the first external fitting (PK1) by way of the fourth control channel (MV4).

13. The body according to claim 4, comprising an additional flow circuit (VP10) for enabling an additional function, the additional flow circuit (VP10) comprising:

the second outlet (D1) and the first inlet (C2), as well as the additional connecting channel (YK1) provided therebetween and the second connecting channel (YK2) provided between the second outlet (D1) and the additional connecting channel (YK1), wherein the second outlet (D1) connects with the second connecting channel (YK2) by way of the second control channel (MV2) and wherein the additional connecting channel (YK1) connects with the first inlet (C2) by way of a third control channel (MV3), as well as the second inlet (D2) connecting with the first inlet (C2) by way of the connecting channel (YK3), and wherein the second outlet (D1) is adapted to be connected onto the first side (S3) of the second actuator (E2) and the second inlet (D2) is adapted to be connected onto the second side (S4) of the second actuator (E2), and in order to enable the equalization of an underpressure generated on the first side (S3) of the second actuator (E2), the second outlet (D1) is adapted to conduct a pressure flow from the second side (S4) of the second actuator (E2) by way of the second inlet (D2) along the connecting channel (YK3) to the first inlet (C2) and into the third control channel (MK3) and further along the additional connecting channel (YK1) into the second connecting channel (YK2) and further onto the first side (S3) of the second actuator (E2) by way of the second control channel (MV2) and the second outlet (C2).

14. The body according to claim 5, comprising an additional flow circuit (VP11) for enabling an additional function, the additional flow circuit (VP11) comprising:

the second outlet (D1) and the first external fitting (PK1), as well as the connecting channel (YK1) provided between the second outlet (D1) and the first inlet (C2) and the second connecting channel (YK2) provided between the second outlet (D1) and the additional connecting channel (YK1), wherein the second outlet (D1) connects with the second connecting channel (YK2) by way of the second control channel (MV2) and wherein the additional connecting channel (YK1) connects with the first inlet (C2) by way of the third control channel (MV3), as well as the second inlet (D2) which connects with the first inlet (C2) by way of the third connecting channel (YK3), and moreover the fourth control channel (MV4) provided between the second inlet (D2) and the first external fitting (PK1), and wherein the second outlet (D1) is adapted to be connected onto the first side (S3) of the second actuator (E2), and in order to enable the equalization of an underpressure generated on the first side (S3) of the second actuator (E2), the second outlet (D1) is adapted to conduct a pressure flow from the first external fitting (PK1) to the second outlet (D1) along the fourth control channel (MV4) by way of the second inlet (D2) into the third connecting channel (YK3) and by way of the first inlet (C2) and the third control channel (MV3) further into the additional connecting channel (YK1), into the second connecting channel (YK2), and further to the second outlet (D1) by way of the second control channel (MV2).

15. The body according to claim 1, wherein the body comprises at least a third outlet (B1), a fourth outlet (A1), a third inlet (B1), and a fourth inlet (A2), channels provided in the body between the first main line (P1) and the third and fourth outlets (B1, A1) as well as between the second main line (P2) and the third and fourth inlets (B2, A2), as well as control channels (MB1, MB2, MA1, MA2) fitted in connection therewith for control valves operating independently of each other for conducting a pressure flow from the first main line (P1) to the third outlet (B1) or the fourth outlet (A1) by way of the channel and for conducting a pressure flow into the second main line (P2) from the third inlet (B2) or the fourth inlet (A2) by way of the channel.

16. A hydraulic valve mechanism, wherein the mechanism comprises a body according to claim 1, as well as the first and the second cartridge chambers (MK1, MK2) provided in connection with two of said outlets (C1, D1), as well as the first and the second control valves (M1, M2) provided in the first and the second cartridge chambers (MK1, MK2) and capable of being controlled from outside independently of each other for conducting a pressure flow from the first main line (P1) to the actuator (E1, E2) connected to the outlets (C1, D1) in a controllable manner by first and second control valves (M1, M2) by way of the channel (K1, K2), and the third cartridge chamber (MK3) provided in connection with at least one of said inlet fittings (C2, D2) and therein at least one third control valve (M3) operating independently of the other control valves for conducting a pressure flow from the actuators (E1, E2) connected to at least one of the inlets (C2, D2) back into the second main line (P2)

by way of the third channel (K3), by way of the connecting channel (YK3) and the third channel (K3), or by way of the fourth channel (K4)

in a controlled manner by the third control valve (M3).

* * * * *